US005442941A

United States Patent [19]

Kähönen et al.

[11] Patent Number: 5,442,941

[45] Date of Patent: Aug. 22, 1995

[54] PADLOCK

[75] Inventors: Hannu Kähönen, Helsinki; Jukka Pitkänen, Joensuu, both of Finland

[73] Assignee: Abloy Security Ltd Oy, Helsinki, Finland

[21] Appl. No.: 175,254

[22] Filed: Dec. 28, 1993

[30] Foreign Application Priority Data

Feb. 5, 1993 [FI] Finland ..... 930504

[51] Int. Cl.[6] ..... E05B 67/36

[52] U.S. Cl. ..... 70/34; 70/33; 70/455

[58] Field of Search ..... 70/14, 31, 32–34, 70/38 RC, 51, 54–56, 233, 237, 416, 417, 423, 455

[56] References Cited

U.S. PATENT DOCUMENTS

| | | | |
|---|---|---|---|
| 599,245 | 2/1898 | Merrill | 70/33 |
| 621,391 | 3/1899 | Turner | 70/18 X |
| 1,341,439 | 5/1920 | Powers | 70/423 |
| 2,104,981 | 1/1938 | Falk | 70/33 |
| 2,602,319 | 7/1952 | Jacobi | 70/455 |
| 2,656,704 | 10/1953 | Mancuso | 70/32 X |
| 4,183,235 | 1/1980 | Coralli et al. | 70/34 |
| 4,290,279 | 9/1981 | Fish et al. | 70/38 A |
| 4,658,606 | 4/1987 | Tseng | 70/38 A |
| 5,127,244 | 7/1992 | Myers | 70/417 X |
| 5,265,451 | 11/1993 | Phifer | 70/38 R X |

FOREIGN PATENT DOCUMENTS

| | | | |
|---|---|---|---|
| 86275 | 3/1921 | Austria | 70/33 |
| 98986 | 1/1984 | European Pat. Off. | 70/417 |
| 539271 | 3/1922 | France | 70/31 |
| 1010520 | 6/1952 | France | 70/33 X |
| 439631 | 1/1927 | Germany . | |
| 467012 | 10/1928 | Germany . | |
| 2810756 | 9/1978 | Germany . | |
| 435219 | 3/1948 | Italy | 70/33 |
| 472564 | 6/1969 | Switzerland | 70/33 |
| 5556 | of 1889 | United Kingdom | 70/33 |

*Primary Examiner*—Peter M. Cuomo
*Assistant Examiner*—Suzanne L. Dino
*Attorney, Agent, or Firm*—Smith-Hill and Bedell

[57] ABSTRACT

A padlock, having a substantially U-shaped lock body (1), a shackle (2) moveable back and forth between a locked position and a free position, connected in its locked position to both branches (1*a*,1*b*) of the lock body and one end (2*b*) of which extending through one of the branches (1*b*) of the lock body. The lock body (1) is provided with a lock mechanism (3) operated with a key (5) and bolt means (7) connected to the lock mechanism for locking the shackle (2) to the lock body (1). In addition, supported to said end (2*b*) of the shackle (2) extending through one of the branches (1*b*) of the lock body there is a lever element (11), which is transversal with regard to the shackle (2) and is turnable relative to the lock body (1).

12 Claims, 3 Drawing Sheets

PADLOCK

BACKGROUND OF THE INVENTION

The invention relates to a padlock having a substantially U-shaped lock body, a shackle moveable back and forth between a locked position and a free position, connected in its locked position to both branches of the lock body and one end of which extending through one of the branches of the lock body, and inside of the lock body a lock mechanism operated with a key and bolt means connected to the lock mechanism for locking the shackle to the lock body.

An aim of the invention is to further improve a padlock of the mentioned kind and to make it more secure as to its operation and more versatile.

SUMMARY OF THE INVENTION

In an arrangement according to the invention, supported to said end of the shackle extending through one of the branches of the lock body there is a lever element, which is transversal with regard to the shackle and is turnable relative to the lock body. In this manner the movements of the shackle are not dependent on the operation of a spring, but can reliably be accomplished by making use of the lever element in most different using conditions.

The key channel of the lock mechanism is advantageously arranged to open to the same side of the lock body as the end of the shackle provided with the lever element. When the lever element is also so formed and dimensioned, that when the shackle is in its locking position the lever element can be placed tightly along the lock body and extends over the whole side of the lock body in question, so that it covers the key channel of the lock mechanism, the padlock forms a dustproof and compact entity.

For attachment of the lever element said end of the shackle extending through one of the branches of the lock body is formed to comprise a support element, which in the locked position of the shackle extends somewhat outside of the lock body. The lever element is advantageously of plastic and fastened to the said support element of the shackle by means of casting.

The lock body can be made use of in many ways, so that the bolt members locking the shackle to the lock body are placed in a bore made into the outermost branch of the lock body with regard to the lever element. Correspondingly, there is a bore in that branch of the lock body to which the lever element is joined, containing spring loaded blocking means which together with a step made into the vicinity of the opposite end of the shackle with regard to the lever element are arranged to prevent detachment of the shackle from the lock body. In addition a separate auxiliary piece can be installed to the said step, extending around the shackle and being arranged, when pulling the shackle outwards of the lock body, to press the said blocking means into a position, where they allow pulling of the shackle away from the lock body.

The lock body can also include a removable cover element, known as such, arranged in the insertion direction of the key in front of the lock mechanism, and a stop member, arranged in its blocking position to prevent detachment of the cover element from the lock body, whereby the said stop member can with advantage be placed in said bore of the lock body containing the blocking means.

BRIEF DESCRIPTION OF THE DRAWINGS

In the following, the invention will be described more in detail with reference to the attached drawing, in which.

DETAILED DESCRIPTION

Figure 1:
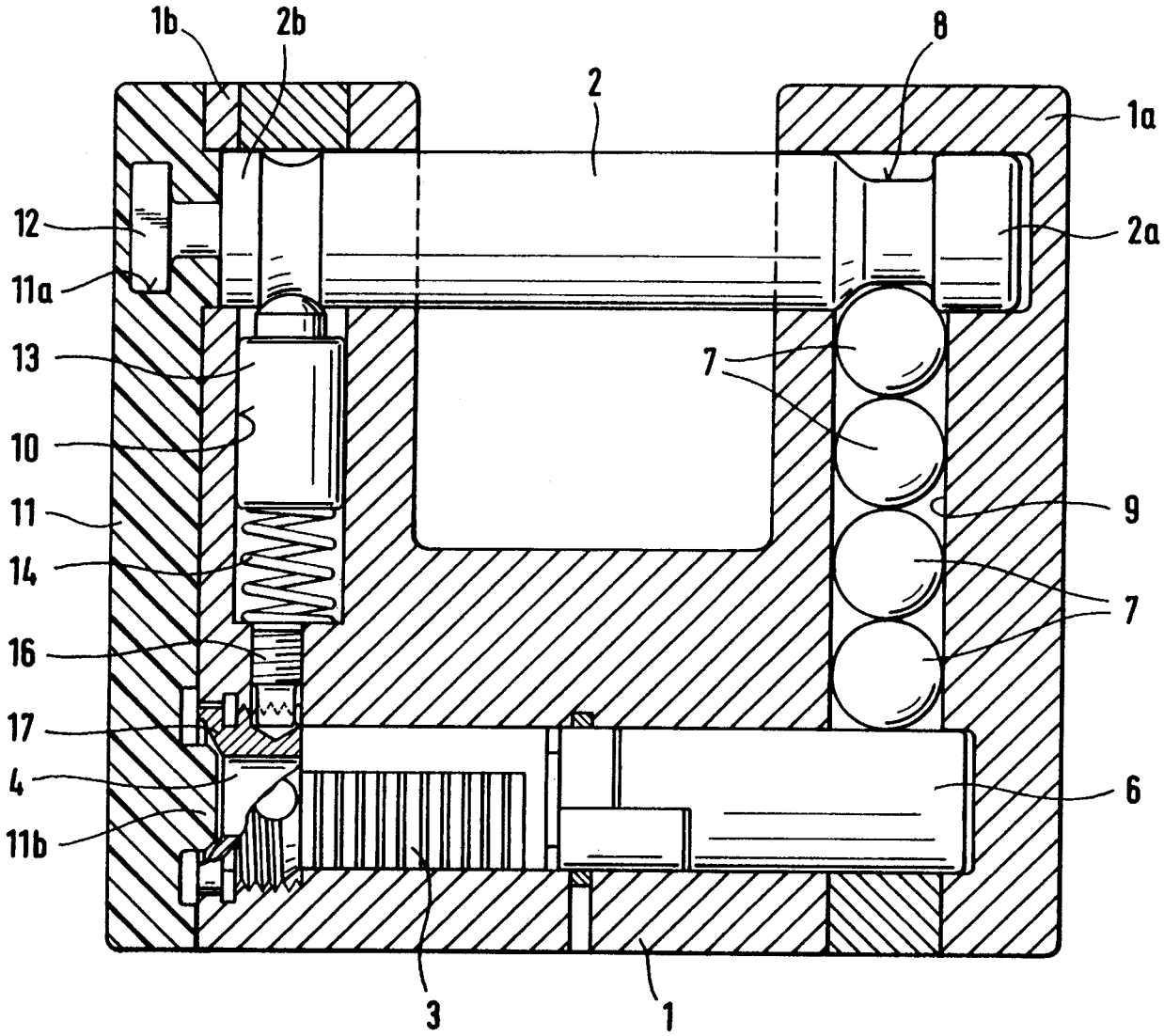
FIG. 1 shows a padlock according to the invention from the side, in a section and with the shackle in its locked position, FIG. 2 correspondingly shows the padlock of FIG. 1 with the shackle in its opened position a bit turned with respect to the lock body.

In the drawing, 1 indicates a U-formed lock body of the padlock, having branches 1*a* and 1*b* with the bores 9 and 10 in them respectively. The lock body 1 is provided with a shackle 2, which in its locked position (FIG. 1) is connected to both branches 1*a* and 1*b* of the lock body and one end 2*b* of which extends through the one branch 1*b* of the lock body, and with a lock mechanism 3, which includes a key channel 4 for a key 5. The lock mechanism 3 is preferably a cylinder lock.

Figure 2:
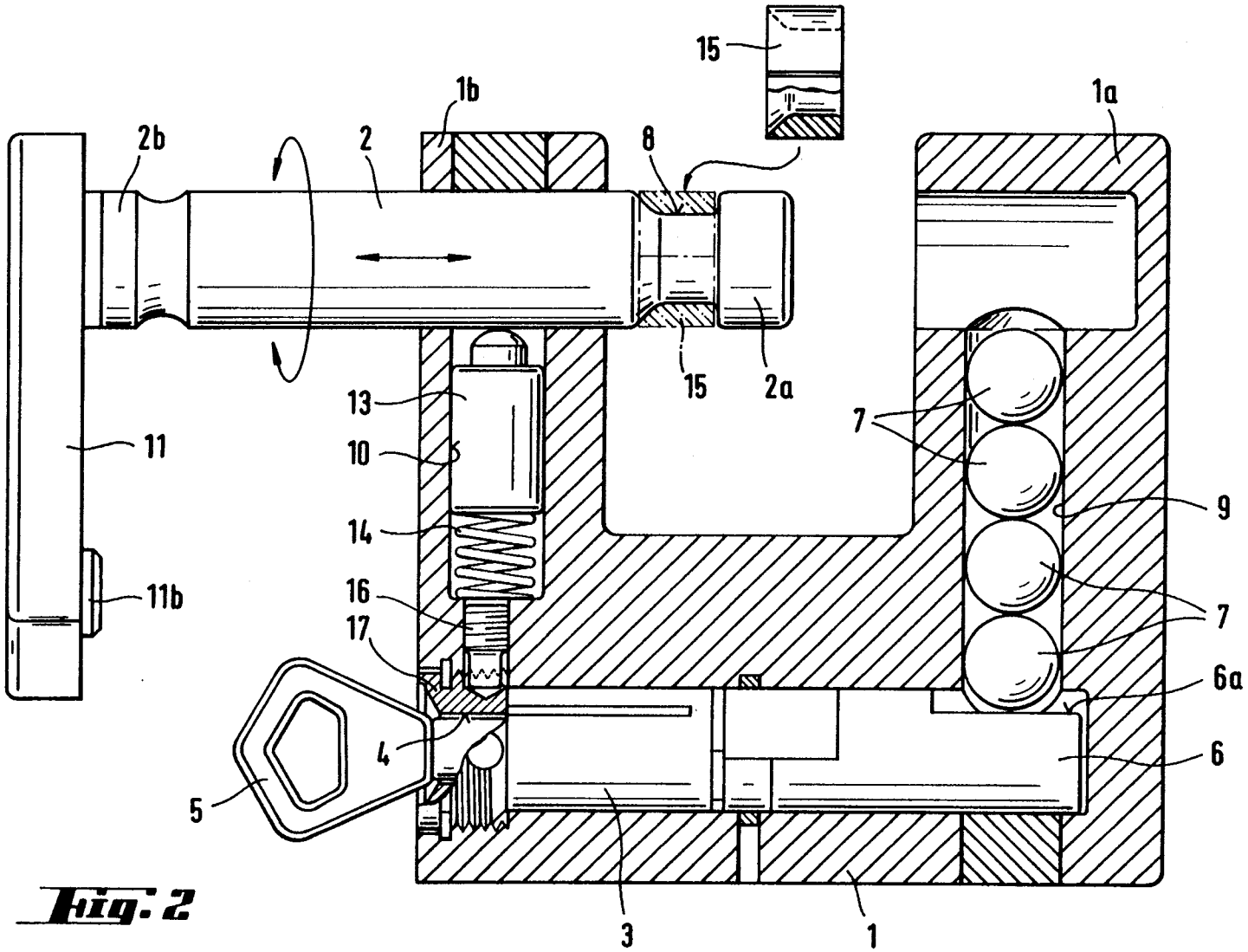
Figure 3:
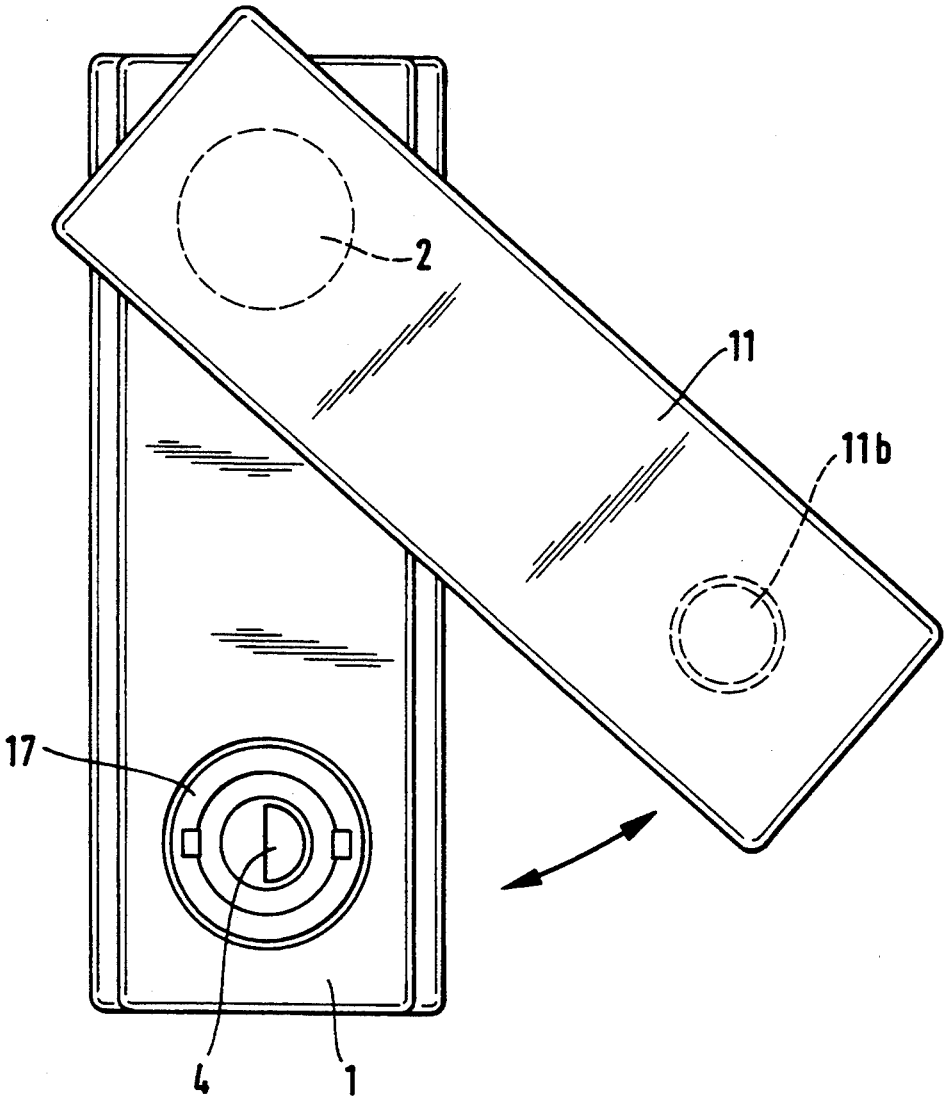
FIG. 3 shows the padlock from the left of FIG. 2 with the lever element turned with respect to the lock body in the opposite direction from that shown in FIG. 2.

A force transmission member 6 is connected to the lock mechanism 3 and effects on bolt means 7, for example a number of balls, which, in the locked position of the shackle 2, together with a step 8 arranged in the shackle end 2*a* in the form of a circumferential groove prevent movement of the shackle 2 into an opened position. The lock mechanism 3 is turnable with the key 5 of the lock into a position, in which a depression 6*a* of the force transmission member 6 is located at the position of the bolt means 7 allowing them to move into a position, in which the shackle 2 can be pulled into the opened position (FIG. 2). The bore 10 includes blocking means 13, which, urged by a spring 14, together with the step 8 formed by the circumferential groove of the shackle prevent pulling of the shackle 2 totally out from the lock body 1. However, a separate piece 15 (FIG. 2) made of elastic material can be placed in said circumferential groove of the shackle 2, preventing the blocking means 13 from engaging the step 8 and thereby making it possible to remove the shackle 2 from the lock body 1.

A lever element 11 is fixed to the end 2*b* of the shackle 2. For this, the end 2*b* of the shackle is with advantage formed to comprise a support element 12 which is fitted into a cavity 11*a* of the lever element. In practice, the lever element 11 is advantageously of plastic, whereby fastening takes place by casting the lever element around the support element 12. Naturally, also any other suitable means can be used for fixing the lever element 11 to the shackle 2.

The lever element 11 is also provided with a protrusion 11*b*, which, in the locked position of the shackle 2, is to be fitted to the end of the key channel 4 at the same time as the entire lever element 11 extends tightly along the side in question of the lock body 1. When the lock is to be opened, the lever element 11 is turned with regard to the axis of the shackle 2, so that the key 5 can be inserted into the key channel 4. After opening the lock mechanism 3 with the key 5 the shackle 2 can be pulled into the opened position with the help of the lever element 11, as shown in FIG. 2. The lever element 11 facilitates handling of the shackle 2. In its basic position, with the shackle 2 being locked, the lever element 11 thus protects the key channel 4 and forms together with the lock body 1 a compact entity.

The lock body 1 is in a known manner also provided with a cover element 17 protecting the lock mechanism 3 and being advantageously supported to the lock body 1 by means of threads. In this case, naturally, the key channel 4 extends through the cover element 17. Removal of the cover element 17 is prevented by means of a stop member 16, located in the bore 10 and preventing turning of the cover element 17. If, on the other hand, the cover element 17 expressly is to be removed, for example for changing the opening combination of the lock mechanism 3, for this purpose the shackle 2 must first be totally removed from the lock body 1 by making use of the piece 15, as is described above, and by removing the blocking means 13 from the bore 10. The cover element 17 can also be fastened to the lock body 1 permanently, for example by means of a locking ring, in case there is no need for changing the lock mechanism 3.

The invention is not restricted to the embodiments shown, but several modifications thereof are feasible within the scope of the attached claims.

We claim:

1. A padlock comprising:

a substantially U-shaped lock body having first and second branches, a shackle moveable back and forth relative to the lock body between a locked position, in which the shackle is connected to the first and second branches of the lock body, and a free position, the shackle having one end that extends through the first branch of the lock body, a key-operated lock mechanism inside the lock body, bolt means inside the lock body, the bolt means being connected to the lock mechanism for locking the shackle to the lock body, and a lever element supported by the shackle at said one end thereof and extending transversely relative to the shackle, the lever element being turnable relative to the lock body.

2. A padlock according to claim 1, wherein the lever element is fixed relative to the shackle and the bolt means allow turning movement of the shackle relative to the lock body.

3. A padlock according to claim 1, wherein the bolt means are located in a bore in the second branch of the lock body.

4. A padlock according to claim 1, wherein the shackle has a portion at said one end thereof that projects from the first branch of the lock body and comprises a support element, and the lever element is fixed to the support element.

5. A padlock according to claim 4, wherein the lever element is made of plastic and is fixed to said support element by means of casting.

6. A padlock comprising:

a substantially U-shaped lock body having first and second branches, the first branch of the lock body having an external surface, a shackle moveable back and forth relative to the lock body between a locked position, in which the shackle is connected to the first and second branches of the lock body, and a free position, the shackle having one end that extends through said external surface of the first branch of the lock body, a key-operated lock mechanism inside the lock body, said lock mechanism defining a key channel that is open at said external surface of the first branch of the lock body, bolt means inside the lock body, the bolt means being connected to the lock mechanism for locking the shackle to the lock body, and a lever element supported by the shackle at said one end thereof and extending transversely relative to the shackle, the lever element being turnable relative to the lock body, and wherein when the shackle is in its locked position, the lever element can be placed so that it fits against said external surface and covers the key channel of the lock mechanism.

7. A padlock according to claim 6, wherein the shackle has a portion at said one end thereof that projects from the first branch of the lock body and forms a support element, and the lever element is fastened to the support element.

8. A padlock according to claim 7, wherein the lever element is made of plastic and is fastened to said support element by means of casting.

9. A padlock comprising:

a substantially U-shaped lock body having first and second branches, the first branch of the lock body being formed with a bore, a shackle moveable back and forth relative to the lock body between a locked position, in which the shackle is connected to the first and second branches of the lock body, and a free position, the shackle having one end that extends through the first branch of the lock body and having an opposite end formed with a step, spring loaded blocking means located in the bore and cooperating with the step at said opposite end of the shackle to prevent detachment of the shackle from the lock body, a key-operated lock mechanism inside the lock body, bolt means inside the lock body, the bolt means being connected to the lock mechanism for locking the shackle to the lock body, and a lever element supported by the shackle at said one end thereof and extending transversely relative to the shackle, the lever element being turnable relative to the lock body.

10. A padlock according to claim 9, further comprising an auxiliary piece that can be installed against the step and arranged to press the blocking means into a position where they allow removal of the shackle from the lock body.

11. A padlock according to claim 9, wherein the lock mechanism defines an insertion direction for the key and the padlock further comprises a removable cover element located in the lock body in front of the lock mechanism in the insertion direction of the key and a stop member having a blocking position in which it prevents removal of the cover element from the lock body.

12. A padlock according to claim 11, wherein the stop member is fitted in the bore in the first branch of the lock body.

* * * * *